US007784565B2

(12) United States Patent
Wells et al.

(10) Patent No.: US 7,784,565 B2
(45) Date of Patent: Aug. 31, 2010

(54) TOP DRIVE SYSTEMS WITH MAIN SHAFT DEFLECTING SENSING

(75) Inventors: Lawrence E. Wells, Yorba Linda, CA (US); Robert Brian Luher, Mission Viejo, CA (US)

(73) Assignee: National Oilwell Varco, L.P., Houston, TX (US)

( * ) Notice: Subject to any disclaimer, the term of this patent is extended or adjusted under 35 U.S.C. 154(b) by 91 days.

(21) Appl. No.: 12/284,022

(22) Filed: Sep. 17, 2008

(65) Prior Publication Data

US 2010/0065336 A1 Mar. 18, 2010

(51) Int. Cl.
*E21B 7/04* (2006.01)
*E21B 47/024* (2006.01)

(52) U.S. Cl. ..... 175/24; 175/45

(58) Field of Classification Search ..... 175/24, 175/45, 113

See application file for complete search history.

(56) References Cited

U.S. PATENT DOCUMENTS

| | | | | |
|---|---|---|---|---|
| 4,662,458 | A | 5/1987 | Ho | 175/27 |
| 4,752,732 | A | 6/1988 | Van Schoiack et al. | 324/208 |
| 5,018,071 | A | 5/1991 | Kihara et al. | 364/474.17 |
| 5,107,210 | A | 4/1992 | Shirao et al. | 324/207.12 |
| 5,585,718 | A | 12/1996 | Kuwahara et al. | 324/207.19 |
| 6,216,533 | B1 | 4/2001 | Woloson et al. | 73/152.45 |
| 6,467,557 | B1 | 10/2002 | Krueger et al. | 175/45 |
| 6,547,016 | B2 | 4/2003 | Wassell | 175/45 |
| 7,334,649 | B2 | 2/2008 | Chen et al. | 175/22 |
| 7,401,664 | B2 | 7/2008 | Wells et al. | 175/52 |
| 7,503,403 | B2 | 3/2009 | Jogi et al. | 175/45 |
| 2006/0124353 | A1 | 6/2006 | Juhasz et al. | 175/40 |
| 2007/0107912 | A1 | 5/2007 | Boutwell et al. | 166/380 |
| 2007/0251701 | A1 | 11/2007 | Jahn et al. | 166/379 |
| 2009/0159336 | A1 * | 6/2009 | Boone | 175/45 |

OTHER PUBLICATIONS

EP 09170426.2 European Search Report (Jan. 15, 2010).
Development of a Surface Drillstring Vibration Measurement System. Besaisow et al. SPE 14327 pp. 1-5. Traces I-VIII. and Figs. 1. 2: 1985.

* cited by examiner

*Primary Examiner*—William P Neuder
(74) *Attorney, Agent, or Firm*—Williams, Morgan & Amerson, P.C.

(57) ABSTRACT

A top drive system for wellbore operations, the top drive system including motor apparatus, a main shaft driven by the motor apparatus, and sensing apparatus for sensing bending of the main shaft; and, in certain aspects, the system providing information regarding the extent of main shaft bending and/or for warning an operator of an undesirable amount of main shaft bending. This abstract is provided to comply with the rules requiring an abstract which will allow a searcher or other reader to quickly ascertain the subject matter of the technical disclosure and is submitted with the understanding that it will not be used to interpret or limit the scope or meaning of the claims, 37 C.F.R. 1.72(b).

17 Claims, 6 Drawing Sheets

TOP DRIVE SYSTEMS WITH MAIN SHAFT DEFLECTING SENSING

BACKGROUND OF THE INVENTION

1. Field of the Invention

This invention is directed to wellbore drilling top drive systems; such systems including apparatus for sensing deflection of a top drive main shaft; and methods of their use.

2. Description of Related Art

The prior art discloses a variety of top drive systems; for example, and not by way of limitation, the following U.S. patents present exemplary top drive systems and components thereof: U.S. Pat. Nos. 4,458,768; 4,807,890; 4,984,641; 5,433,279; 6,276,450; 4,813,493; 6,705,405; 4,800,968; 4,878,546; 4,872,577; 4,753,300; 6,007,105; 6,536,520; 6,679,333; 6,923,254—all these patents incorporated fully herein for all purposes.

Certain typical prior art top drive drilling systems have a derrick with a top drive which supports and rotates tubulars, e.g., drill pipe. The top drive is supported from a travelling block beneath a crown block. A drawworks on a rig floor raises and lowers the top drive. In many cases, a top drive is secured to a dolly that moves on a guide track in the derrick.

A top drive has a main drive shaft that is rotated by one or more motors. This main drive shaft supports significant weights, including, during certain operations, the weight of a drill string. For effective and efficient operations, it is important that the top drive main shaft remain aligned with a load supported on the top drive main shaft and/or with a well center of a well above which the top drive is positioned. Misalignment can result from incorrect positioning of dolly guide tracks or incorrectly positioning a top drive on a dolly, either laterally or at an angle to a well center line. Misalignment can also result if a dolly retract system does not position the top drive over well center.

In the past, efforts to maintain alignment of a top drive main shaft have included various mechanical position or attitude adjustment apparatuses and arrangements of hydraulic cylinders to relieve bending loads caused by shaft misalignment. In the past, due to the relative high stiffness of a top drive main shaft, it has not been obvious to use a sensor to detect top drive main shaft deflection. This was also not obvious because the main shafts are so stiff that detecting damaging bending was beyond economical sensor resolution.

BRIEF SUMMARY OF THE INVENTION

The present invention, in certain aspects, provides a top drive system for wellbore operations above a well, e.g., above a well center of a well, the top drive system including: a main body; a motor (or motors) for rotating the main shaft; a main shaft extending from the main body, the main shaft having a top end and a bottom end, the main shaft having a gear system driven by the motor apparatus so that driving the gear system results in rotation of the main shaft; and sensing apparatus for sensing bending of the main shaft (which can be caused by misalignment between the main shaft and the direction of a load being supported by the main shaft). In one aspect (as may be the case in any system according to the present invention), the main shaft has a relatively long slender central section to allow bending deflection without damaging stress.

The present invention discloses, in certain aspects, a top drive system for wellbore operations above a well, the top drive systems including: a main body; a main shaft extending from the main body, the main shaft having a top end and a bottom end, the main shaft having a main shaft flow bore therethrough from top to bottom through which drilling fluid is flowable; a main shaft housing enclosing a portion of the main shaft, the main shaft having a non-loaded position relative to the main shaft housing; and sensing apparatus located for sensing bending of the main shaft away from the non-loaded position. In one particular aspect, a top drive system's main shaft has been reduced (e.g. from one typical shaft that has an outer diameter of 13.75 inches) to a shaft with an diameter of 9 inches, rendering the shaft more flexible yet with sufficient strength to handle expected loads, e.g. a 2500 kps load.

The present invention discloses, in certain aspects, methods for sensing deflection of a main shaft of a top drive system, the top drive system as any described or referred to herein, the method including sensing with sensing apparatus position of the main shaft. In one particular aspect, a top drive system's main shaft has been reduced (e.g. from one typical shaft that has an outer diameter of 13.75 inches) to a shaft with an diameter of 9 inches, rendering the shaft more flexible yet with sufficient strength to handle expected loads, e.g. a 2500 kps load.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain preferred embodiments of the invention, there are other objects and purposes which will be readily apparent to one of skill in this art who has the benefit of this invention's teachings and disclosures. It is, therefore, an object of at least certain preferred embodiments of the present invention to provide:

New, useful, unique, efficient, non-obvious top drive systems and methods of their use; and Such systems with a sensor apparatus for sensing bending of a top drive main shaft which could cause damage to the main shaft or to related components.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention in any way.

It will be understood that the various embodiments of the present invention may include one, some, or all of the disclosed, described, and/or enumerated improvements and/or technical advantages and/or elements in claims to this invention.

Certain aspects, certain embodiments, and certain preferable features of the invention are set out herein. Any combination of aspects or features shown in any aspect or embodiment can be used except where such aspects or features are mutually exclusive.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

Figure 1:
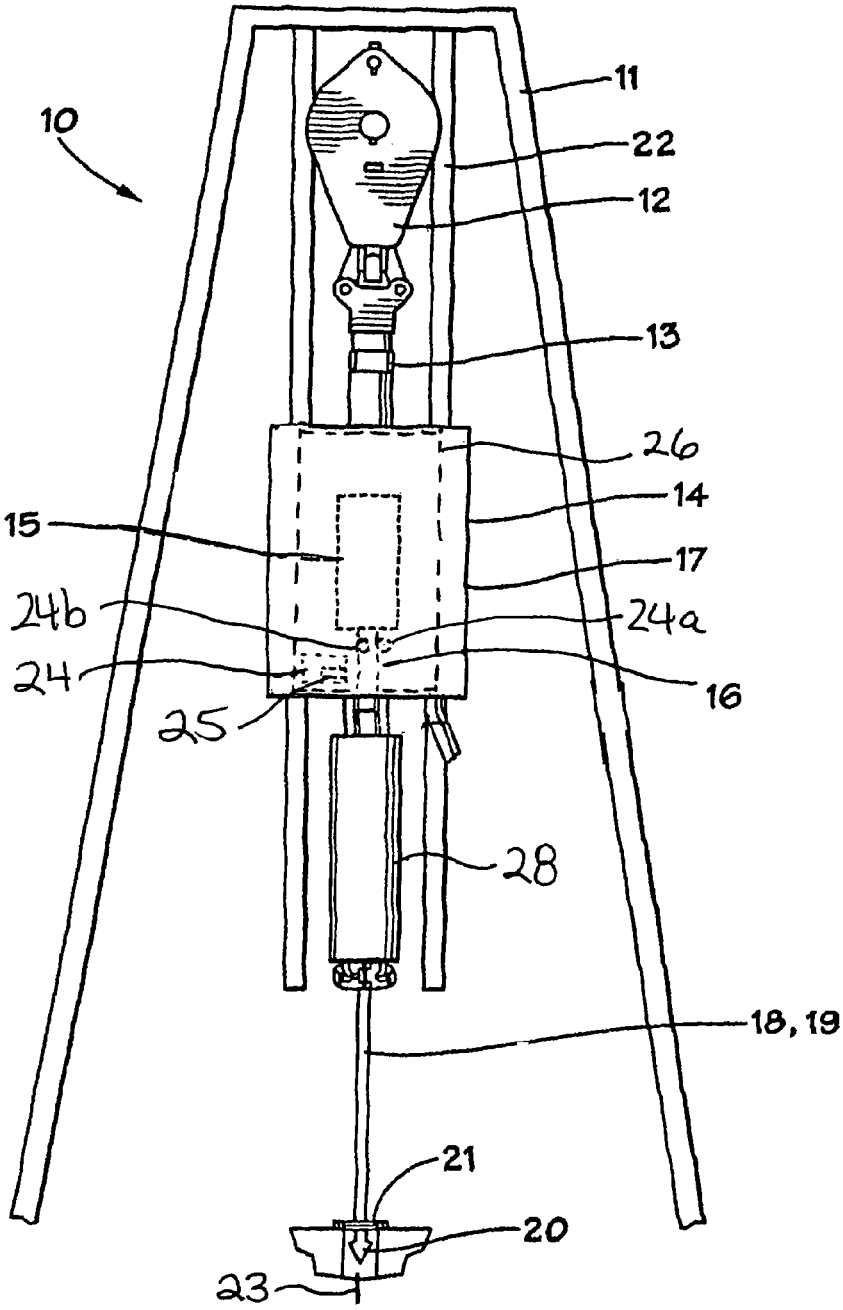
FIG. 1 is a schematic view of a top drive system in a derrick according to the present invention.

Presently preferred embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein.

DETAILED DESCRIPTION OF THE INVENTION

FIG. 1 illustrates a top drive system 10 according to the present invention which is structurally supported by a derrick 11. The system 10 has a plurality of components including: a swivel 13, a top drive 14 according to the present invention (any disclosed herein), a main shaft 16, a housing 17, a drill stem 18/drillstring 19 and a drill bit 20. The components are collectively suspended from a traveling block 12 that allows them to move upwardly and downwardly on a dolly 26 on rails 22 connected to the derrick 11 for guiding the vertical motion of the components. Torque generated during operations with the top drive or its components (e.g. during drilling) is transmitted through the dolly 26 via the rails 22 to the derrick 11. The main shaft 16 extends through the motor housing 17 and connects to the drill stem 18. The drill stem 18 is typically threadedly connected to one end of a series of tubular members collectively referred to as the drillstring 19. An opposite end of the drillstring 19 is threadedly connected to a drill bit 20.

During operation, a motor apparatus 15 (shown schematically) encased within the housing 17 rotates the main shaft 16 which, in turn, rotates the drill stem 18/drillstring 19 and the drill bit 20. Rotation of the drill bit 20 produces an earth bore 21 with a well center 23. Fluid pumped into the top drive system passes through the main shaft 16, the drill stem 18/drillstring 19, the drill bit 20 and enters the bottom of the earth bore 21. Cuttings removed by the drill bit 20 are cleared from the bottom of the earth bore 21 as the pumped fluid passes out of the earth bore 21 up through an annulus formed by the outer surface of the drill bit 20 and the walls of the bore 21. Pipe handling apparatus 28 can be suspended from the top drive.

A shaft deflection sensing apparatus 24 connected to the housing 17 has a sensor 25 (or multiple sensors 25) to sense deflection of the main shaft 16.

The sensor 25 (or sensors) can be (as is true for any embodiment herein) any known sensor for detecting bending of the main shaft away from the direction it assumes when it is not supporting a load (often this is a direction in which the main shaft is aligned with the well center). In one aspect, the sensor(s) are inductive proximity distance sensors. Optionally, the sensor(s) may be (but are not limited to) capacitative proximity sensors, ultrasonic distance sensors, photoelectric sensors, or laser distance-measuring devices. In certain cases, if the expected direction of an anticipated excessive load is known, a single sensor can be used to provide a sufficient warning of undesirable shaft bending deflection to an operator. If the direction of such a load is not known, two or more distance sensors are used. Alternatively, or in addition to these sensors, the sensor(s) may be a sensor (or sensors) 24*a*, (shown schematically, FIG. 1) mounted on the outer surface of the main shaft, and/or a sensor (or sensors) 24*b* within the main shaft, directly measuring main shaft deflection and transmitting this data, e.g. via telemetry, wirelessly or via electrical slip ring(s).

Figure 2A:
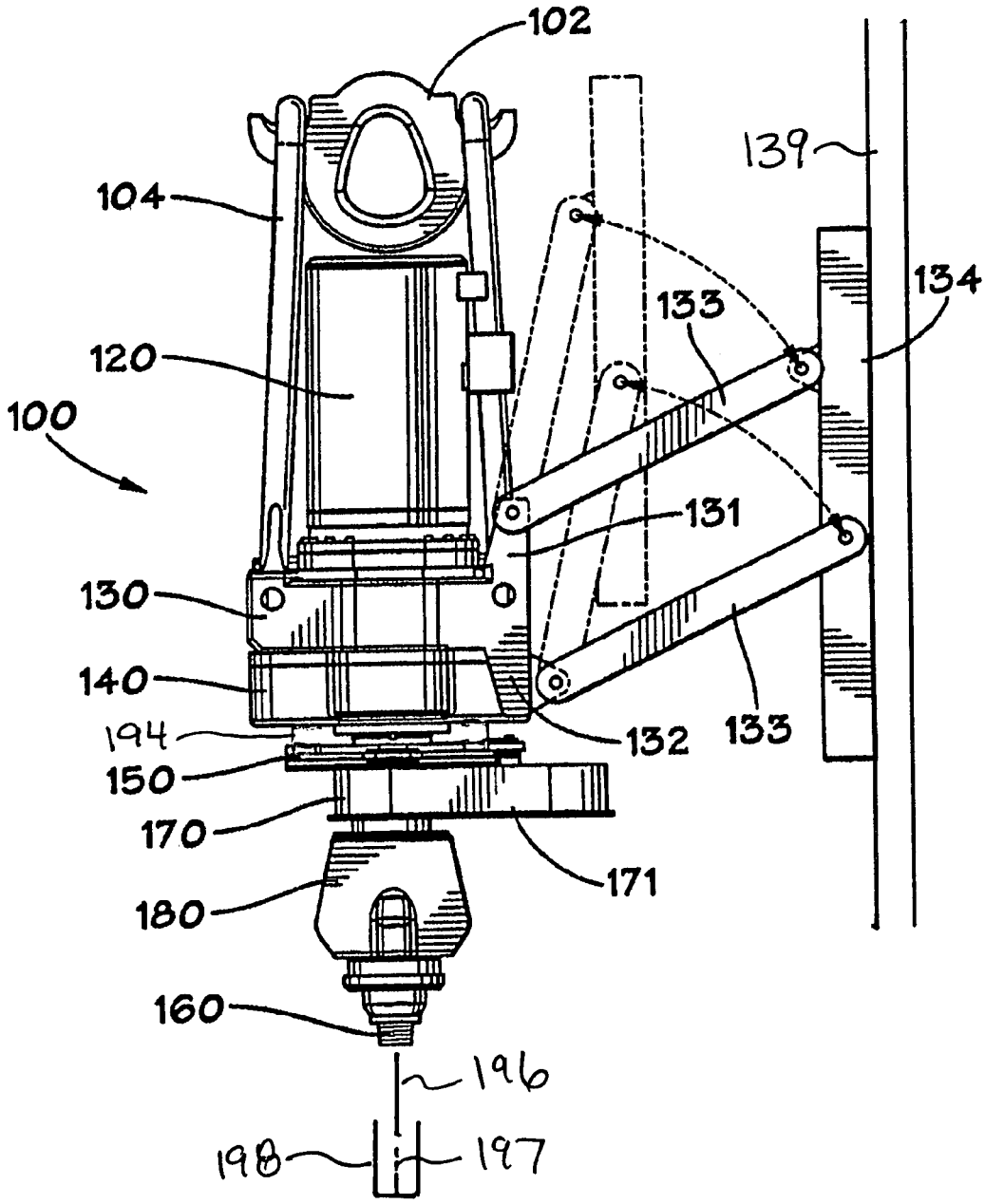
FIG. 2A is a side view of a top drive system according to the present invention.
Figure 2B:
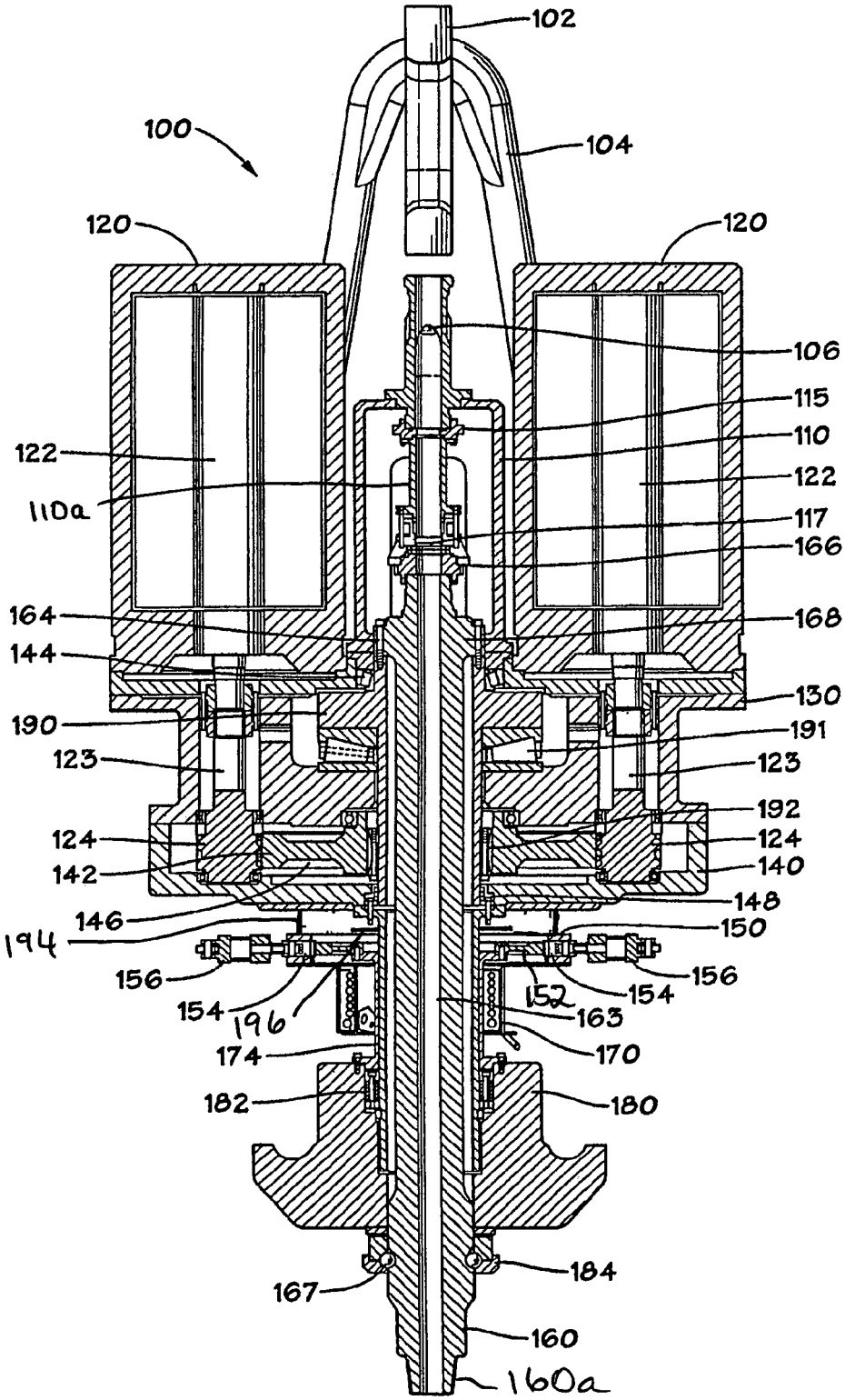
FIG. 2B is a cross-section view of a top drive system of FIG. 2A.

FIGS. 2A and 2B illustrate a top drive system 100 according to the present invention (which may be used as the top drive system 10, FIG. 1) which has supporting bails 104 suspended from a becket 102. Motors 120 which rotate a main shaft 160 are supported on a main body 130. One motor may be used. A bonnet 110 supports a gooseneck 106 and a washpipe 110*a* through which fluid is pumped to and through the system 100 and through a flow channel 163 through a main shaft 160. Within the bonnet 110 are an upper packing box 115 (connected to the gooseneck 106) for the washpipe; and a lower packing box 117 for the washpipe. A main gear housing 140 encloses a bull gear 142. A ring gear housing 150 encloses a ring gear 152 and associated components.

A drag chain system 170 encloses a drag chain 172 and associated components including hoses and cables. This drag chain system 170 can be used instead of a rotating head and provides rotation for reorientation of a link adapter 180 and items connected thereto.

Bolts releasably secure the bonnet 110 to the body 130. Removal of these bolts permits removal of the bonnet 110. Bolts 164 through a load shoulder 168 releasably secure the main shaft 160 to a quill 190. The quill 190 is a transfer member between the main shaft 160 and the bull gear 142 and transfers torque between the bull gear 142 and the main shaft 160. The quill 190 also transfers the tension of a tubular or string load on the main shaft to thrust bearings 191 (not to the bull gear 142). One or more seal retainer bushings 166 are located above the load shoulder 168. Removal of the bonnet 110 and bolts through the load shoulder 168 securing the main shaft 160 to a quill 190, permits removal of the main shaft 160 from the system 100 without exposing or disturbing the inner components of the gear box or the main thrust bearings 191. Upper quill bearings 144 are above a portion of the quill 190.

As shown in FIG. 2B, the system 100 is movable on a mast or part of a derrick 139 (like the derrick 11 and on its rails 22) by connection to a movable apparatus like a dolly 134. Ends of links 133 are pivotably connected to arms 131, 132 of a body 130. The other ends of the links 133 are pivotably connected to the dolly 134. This structure permits the top drive and associated components to be moved up and down, and toward and away from a well centerline (e.g. like a line in line with the well center 23, FIG. 1), as shown by the structure in dotted line (toward the derrick when drill pipe is connected/disconnected while tripping; and to the well center during drilling). Known apparatuses and structures are used to move the links 133 and to move the dolly 134.

Upper parts of the bails 104 extend over and are supported by arms 103 of the becket 102. Each bail 104 has two spaced-apart lower ends 105 pivotably connected by pins to the body 130. Such a use of two bails distributes the support load on the main body and provides a four-point support for this load, economically reducing bending moments within the main body and thus provide a more stable platform for the bearings 191.

The quill 190 rests on main thrust bearings 191 which support the quill 190, the main shaft 160, and whatever is connected to the main shaft 160 (including whatever load is borne by the main shaft 160 during operations, e.g. drilling loads and tripping loads). The body 130 houses the main thrust bearings 191 and contains lubricant for the main thrust bearings 191. An annular passage provides a flow path for lubricant from the gear housing 140 to the thrust bearings.

Shafts 122 of the motors 120 drive couplings 123 rotatably mounted in the body 130 which drive drive pinions 124 in the main gear housing 140. The drive pinions 124 drive the bull gear 142 which is connected to the quill 190 with connectors 192.

The bull gear 142 is within a lower portion 146 of the gear housing 140 which holds lubricant for the bull gear 142 and bearings and is sealed with seal apparatus 148 so that the lubricant does not flow out and down from the gear housing 140. Any suitable known rotary seal 148 may be used.

The ring gear housing 150 which houses the ring gear 152 also has movably mounted therein two sector gears 154 each movable by a corresponding hydraulic cylinder apparatus 156 to lock the ring gear 152. With the ring gear 152 unlocked (with the sector gears 154 backed off from engagement with the ring gear 152), items below the ring gear housing 150 (e.g. a pipe handler and a link adapter) can rotate. The ring gear 152 can be locked by the sector gears 154 to act as a backup to react torque while drill pipe connections are being made to the drillstring. The ring gear 152 is locked when a pipe handler is held without rotation (e.g. when making a connection of a drill pipe joint to a drillstring). An hydraulic motor (not shown), via interconnected gearing, turns the ring gear to, in turn, rotate the link adapter 180 and whatever is suspended from it; i.e., in certain aspects to permit the movement of a supported tubular to and from a storage area and/or to change the orientation of a suspended elevator, e.g. so that the elevator's opening throat is facing in a desired direction. Typical rig control systems are used to control this motor and the apparatuses 156 and typical rig power systems provide power for them.

In a variety of prior top drive systems a rotating head with a plurality of passageways therethrough is used between some upper and lower components of the system to convey hydraulic and pneumatic power used to control system components beneath the rotating head. Such a rotating head typically rotates through 360 degrees infinitely. Such a rotating head may, according to certain aspects of the present invention, be used with system according to the present invention; but, in other aspects, a drag chain system 170 is used below the ring gear housing 150 and above the link adapter 180 to convey fluids and signals to components below the ring gear housing 150. The drag chain system 170 does not permit infinite 360 degree rotation, but it does allow a sufficient range of motion in a first direction or in a second opposite direction to accomplish all the functions to be achieved by system components suspended from the link adapter 180 (e.g. an elevator and/or a pipe handler), in one aspect with a range of rotative motion of about three-quarters of a turn total, 270 degrees.

Optionally, instead of a typical rotating head or a drag chain system according to the present invention, a variety of known signal/fluid conveying apparatuses may be used with systems according to the present invention; e.g., but not limited to, wireless systems or electric slip ring systems, in combination with simplified fluid slip ring systems.

A sensing apparatus 194 has sensors 196 for sensing the position of the main shaft 160. The main shaft is above a well center 197 of a well 198.

Drilling loads (the load of the drillstring, bit, etc.) pass through a threaded connection 160*a* at the end of the main shaft 160 to the main shaft 160. Tripping loads (the load, e.g., of tubular(s) being hauled and manipulated into and out of the well) pass through the link adapter 180 and through a load ring 161, not through the threaded connection of the main shaft and not through any threaded connection so that threaded connections of the top drive are isolated from tripping loads.

Figure 3:
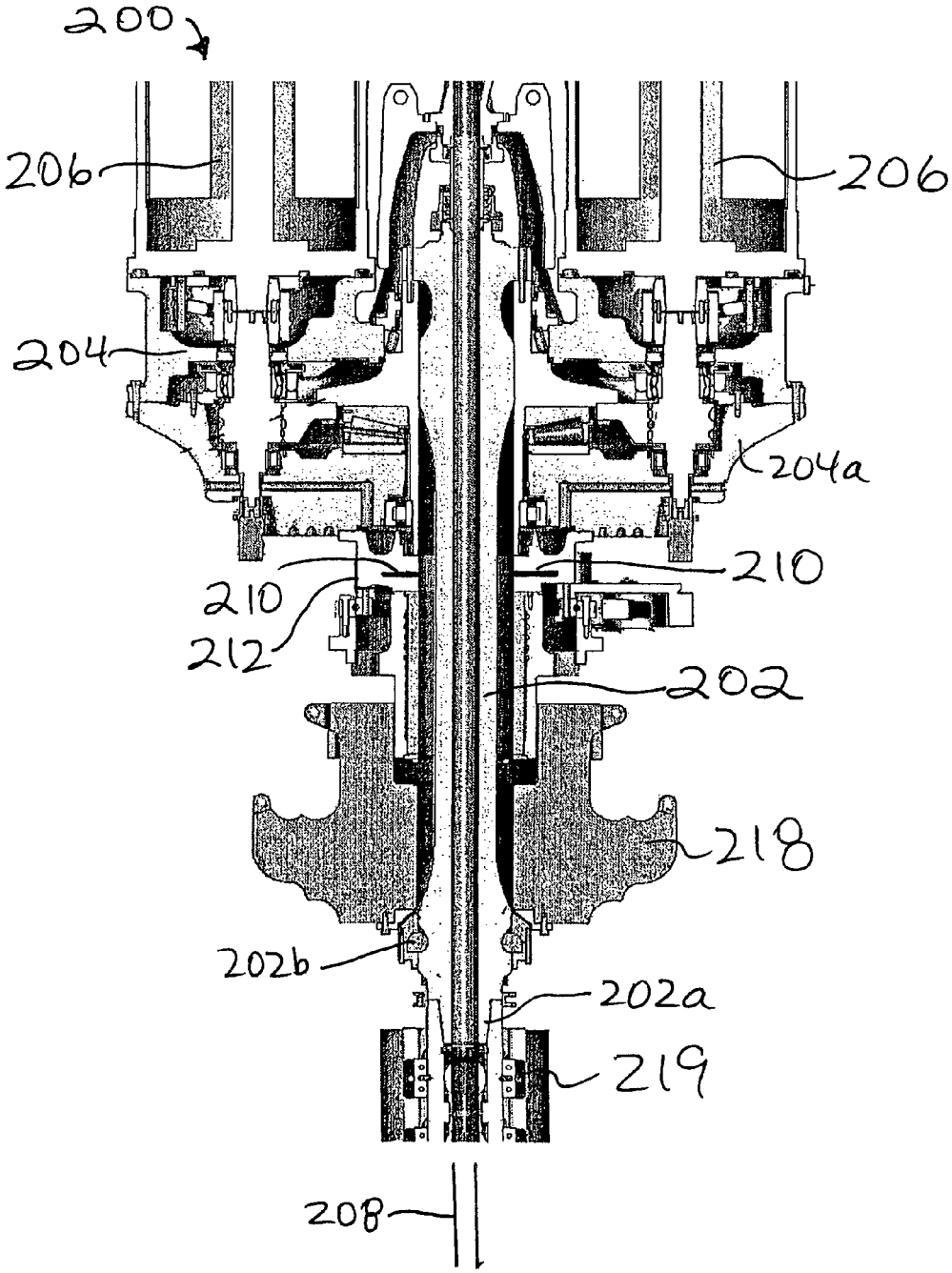
FIG. 3 is a cross-section view of a top drive system according to the present invention.

FIG. 3 shows a top drive system 200 according to the present invention which has a main shaft 202 rotated by a gear system 204 driven by motors 206 (shown partially). Deflection sensors 210 secured to an extension of main shaft housing 212 are positioned to sense the location of the main shaft 202 with respect to a center line of the main shaft housing 212.

A link adapter 218 is above an IBOP 219. The IBOP 219 and a drill string 208 (shown schematically) are supported by the main shaft 202 at a threaded connection 202*a*. Drilling loads pass through the threaded connection 202*a* to the main shaft 202. Tripping loads pass through the link adapter 218 and through a load ring 202*b* (not through a threaded connection of the top drive).

Figure 4A:
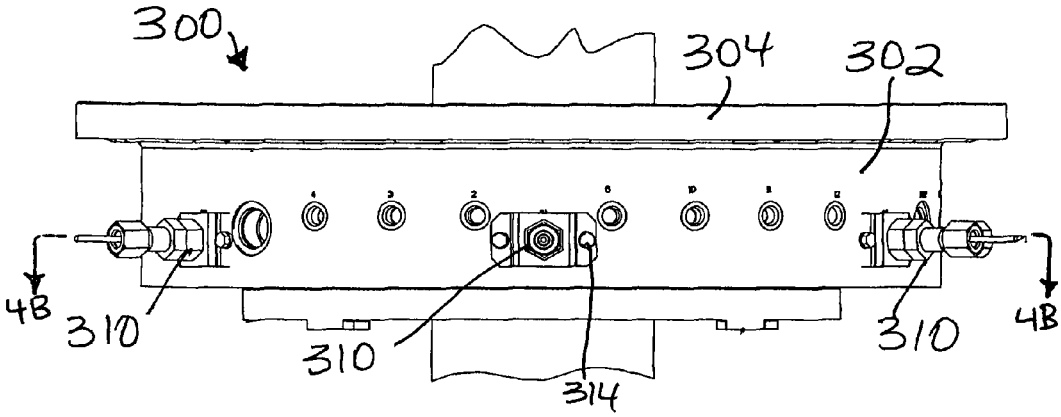
FIG. 4A is a side view of a sensor system according to the present invention.
Figure 4B:
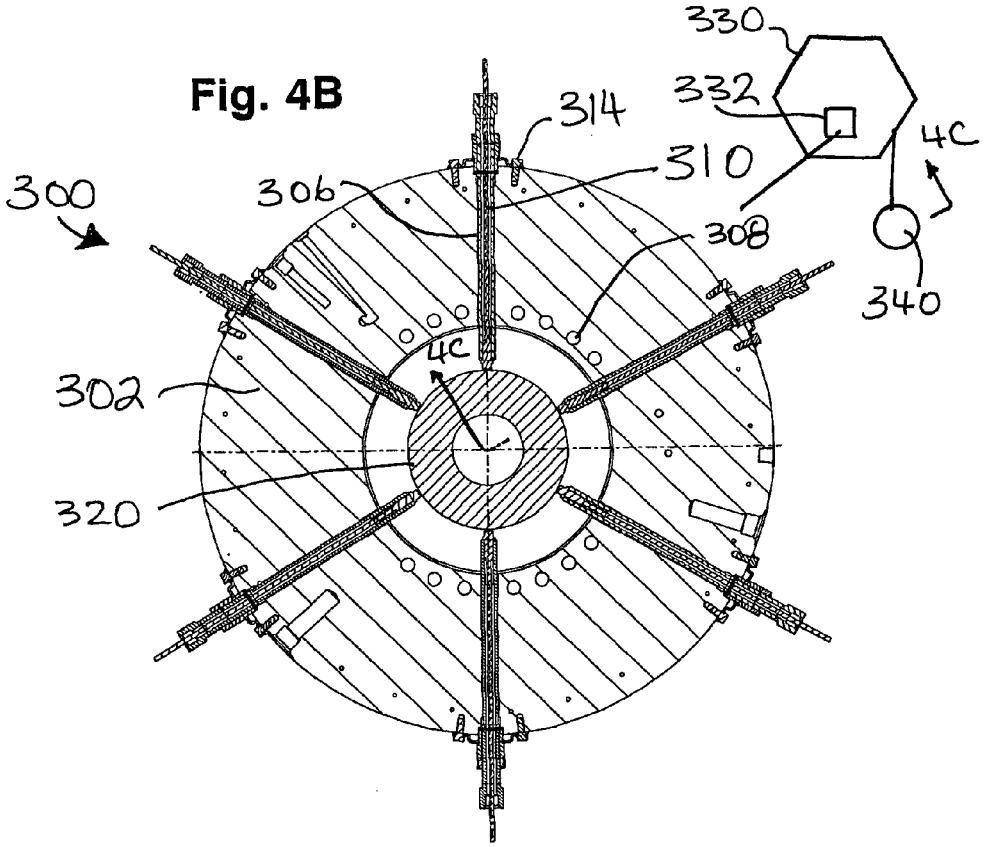
FIG. 4B is a cross-section view of the sensor system of FIG. 4A along line 4B-4B of FIG. 4A.
Figure 4C:
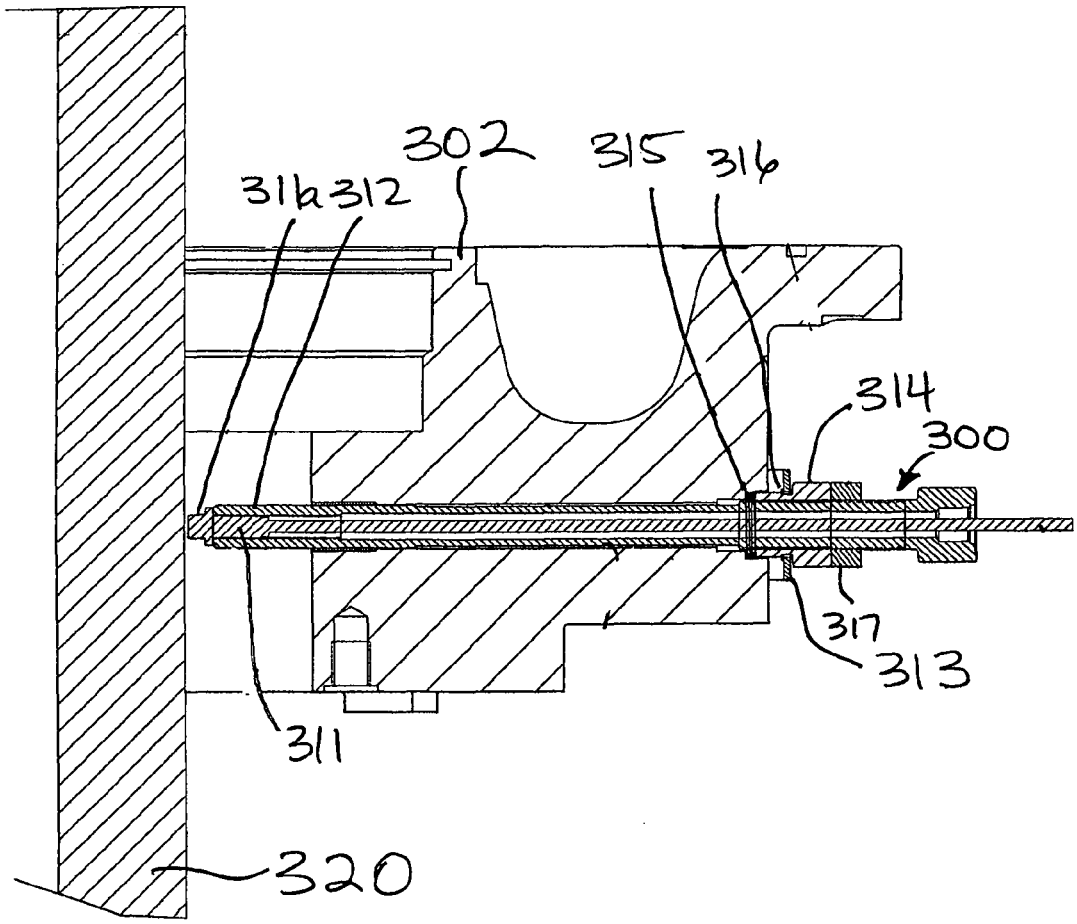
FIG. 4C is a partial cross-section view of the sensor system of FIG. 4A along line 4C-4C of FIG. 4A.

FIGS. 4A-4C illustrate a sensor system 300 according to the present invention which can be used to sense top drive main shaft deflection from a normal un-loaded position relative to the housing, thus measuring bending deflection and stress. The systems 300 are mounted to an extension body 302 with an upper flange 304 to facilitate connection of the systems 300 to the main shaft housing 204*a* (FIG. 3).

The sensor systems 300 have bodies 312 disposed in channels 306 through the body 302 which house sensors 311. Retainers 313 releasably secure the sensor bodies 312 to the body 302.

As shown, six sensors 311 are spaced-apart roughly equally around the body 302 which encompasses a main shaft 320 of a top drive system. The holes 308 provide passages for hydraulic fluid for the rotating head.

A control system 330 has an electronic circuit 332 which is in communication with the sensors 311 and monitors outputs in real-time from the sensors 311 which can indicate, in real-time, acceptable deflection and undesirable deflection of the main shaft 320. If undesirable deflection is detected, the control system 330 sends a warning to an operator (e.g., but not limited to, a visual and/or audible warning to a driller's console 340).

In one embodiment of the present invention, the system warns an operator of undesirable loading on the main shaft in any direction. Sensors are positioned in a radial array around the main shaft in an annular space between the main shaft and a main shaft support housing. In one aspect, the sensors 311 are inductive proximity distance sensors mounted with respect to the top drive main shaft so that they switch state when the top drive main shaft 320 is deflected (bent) beyond a pre-determined safe amount. The sensors can switch state from open-circuit to close-circuit, or vice-versa. The state of the sensors is monitored by an electronic circuit and, when a switched state of the sensors is detected (e.g. when an unsafe side load or bending moment is externally applied to the top drive main shaft), the control system 330 sends a warning to an operator allowing correction of the loading condition before significant damage can occur (including significant fatigue damage to main shaft material). Alternatively, the sensors 311 are analog distance sensors and the control system 330 evaluates and transmits the amount of shaft deflection to warn an operator of an unsafe condition and/or to calculate cumulative fatigue damage (for reporting and/or warning).

In one aspect, the positions of the sensors are adjusted radially relative to the main shaft until each detects the presence of the main shaft and then each is advanced an additional amount towards the main shaft that equates to a desired main shaft deflection alarm point. This alarm point is based on an allowable deflection of the main shaft at the elevation of the sensors. When the main shaft deflects beyond this alarm point, the sensor opposite the deflection direction will no longer detect the presence of the main shaft and will open the electrical circuit, causing the sensors' monitoring circuit to send the alarm to the top drive operator. Should a sensor or wire in the sensing system fail, the electrical circuit will open, again tripping the alarm. Because the allowable deflection of the main shaft is small, the sensors are, preferably, positioned and held in place with precision, without radial free-play or backlash. Each sensor, as shown in FIG. 4C, has an inductive proximity sensor head 311*a* which will close a circuit when it detects the metal of the main shaft 320 within a sensing range, e.g. about 4 mm. The electrical circuit remains closed so long as the main shaft is within the pre-set sensing range.

A support adapter 312 rigidly supports the sensor member 311 and allows for fine radial adjustment of the relative position of the member 311 with respect to the main shaft 320. Use of such an adapter 312 permits sensor removal and replacement while a top drive system with the main shaft 320 is fully assembled (which can reduce maintenance down time). A wave spring 315 which applies axial force on the adapter 312 reduces or eliminates radial backlash between a keeper 313 and the adapter 312.

A swivel nut 314 is held by the keeper 313 and a snap ring 316 which restrain the swivel nut 314 from outward radial movement and assists in maintaining the adapter's and sensor's radial position relative to the normal unloaded position of the top drive main shaft. Rotation of the swivel nut 314 relative to the adapter 312 translates the inductive proximity sensor member 311 axially (toward or away from the main shaft 320). A jam nut 317 prevents the swivel nut 314 from rotating freely and reduces or eliminates backlash (unrestrained axial motion of a sensor) between the adapter 312 and the swivel nut 314.

The present invention, therefore, provides in some, but not in necessarily all, embodiments a top drive system for wellbore operations for a well with a well center on a well center line, the top drive system including: a main body; a motor apparatus; a main shaft extending from the main body, the main shaft having a top end and a bottom end, the main shaft having a main shaft flow bore therethrough from top to bottom through which drilling fluid is flowable; a quill connected to and around the main shaft; a gear system interconnected with the quill, the gear system driven by the motor apparatus so that driving the gear system drives the quill and thereby drives the main shaft, the main shaft passing through the gear system; and sensing apparatus for sensing bending of the main shaft away from its normal (unloaded) position.

The present invention provides, therefore, in some, but in not necessarily all, embodiments a top drive system for wellbore operations above a well, the top drive system having: a main body; a main shaft extending from the main body, the main shaft having a top end and a bottom end, the main shaft having a main shaft flow bore therethrough from top to bottom through which drilling fluid is flowable; sensing apparatus located for sensing bending of the main shaft away from the non-loaded position, in one aspect the sensing apparatus on or in a main shaft housing enclosing a portion of the main shaft, the main shaft having a non-loaded position relative to the main shaft housing. Such a system may, according to the present invention, have one, or some, in any possible combination, of the following: the sensing apparatus located on the main shaft housing; the sensing apparatus on the main shaft; the sensing apparatus including an apparatus body connected to the main shaft housing, a plurality of sensors extending through the apparatus body, each sensor having a sensor head adjacent an exterior surface of the main shaft, each sensor for sensing deflection of the main shaft with respect to the sensor head; each sensor is an inductive proximity distance sensor; wherein each sensor is removably located in the apparatus body; wherein each sensor is an analog distance sensor; wherein the sensors are spaced-apart around the apparatus body and each sensor is supported by a support which allows fine radial adjustment of the position of the sensor's sensor head with respect to the main shaft; a control system in communication with each sensor for monitoring sensor output; wherein the control system provides an operator with an indication of main shaft deflection in real-time; wherein the control system provides an operator with a warning of undesirable main shaft deflection in real-time; wherein the sensing apparatus has at least one sensor that is one of capacitative proximity sensor, ultrasonic distance sensor, photoelectric sensor, laser distance-measuring sensor, and inductive proximity distance sensor; wherein the sensing apparatus senses main shaft deflection in real-time; and/or wherein the main shaft has an outer diameter of about nine inches.

The present invention provides, therefore, in certain embodiments, a top drive system for wellbore operations above a well, the top drive system including:

a main body;

a main shaft extending from the main body, the main shaft having a top end and a bottom end, the main shaft having a main shaft flow bore therethrough from top to bottom through which drilling fluid is flowable;

a main shaft housing enclosing a portion of the main shaft, the main shaft having a non-loaded position relative to the main shaft housing;

sensing apparatus located for sensing bending of the main shaft away from the non-loaded position;

an apparatus body connected to the main shaft housing;

a plurality of sensors extending through the apparatus body, each sensor having a sensor head adjacent an exterior surface of the main shaft;

each sensor for sensing deflection of the main shaft with respect to the sensor head;

each sensor is an inductive proximity distance sensor;

wherein each sensor is removably located in the apparatus body;

a control system in communication with each sensor for monitoring sensor output;

wherein the control system provides an operator with an indication of main shaft deflection in real-time; and wherein the control system provides an operator with a warning of undesirable main shaft deflection in real-time.

The present invention provides, therefore, methods for sensing deflection of a main shaft of a top drive system, the top drive system as any described or referred to herein, the top drive system having a main body and a main shaft, the method including sensing with the sensing apparatus position of the main shaft. Such a method may include one or some, in any possible combination, of the following: wherein a control system in communication with each sensor for monitoring sensor output and wherein the control system provides an operator with an indication of main shaft deflection in real-time, the method further including providing, with the control system, in real-time an indication of main shaft deflection; wherein the control system provides an operator with a warning of undesirable main shaft deflection in real-time, the method further including providing such a warning; and/or wherein the sensing apparatus includes an apparatus body connected to the main shaft housing, a plurality of sensors extending through the apparatus body, each sensor having a sensor head adjacent an exterior surface of the main shaft, each sensor for sensing deflection of the main shaft with respect to the sensor head, wherein each sensor is removably located in the apparatus body, and wherein the sensors are spaced-apart around the apparatus body and each sensor is supported by a support which allows fine radial adjustment of the position of the sensor's sensor head with respect to the main shaft, the method further including radially adjusting the position of each sensor head with respect to the main shaft In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventor may rely on the Doctrine of Equivalents to determine and assess the scope of the invention and of the claims that follow as they may pertain to apparatus not materially departing from, but outside of, the literal scope of the invention as set forth in the following claims. All patents and applications identified herein are incorporated fully herein for all purposes. It is the express intention of the applicant not to invoke 35 U.S.C. §112, paragraph 6 for any limitations of any of the claims herein, except for those in which the claim expressly uses the words 'means for' together with an associated function. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

What is claimed is:

1. A top drive system for wellbore operations above a well, the top drive system comprising a main body, a main shaft extending from the main body, the main shaft having a top end and a bottom end, a main shaft housing enclosing a portion of the main shaft,the main shaft having a non-loaded position relative to the main shaft housing, and sensing apparatus located for sensing bending of the main shaft away from the non-loaded position, and wherein the sensing apparatus includes an apparatus body connected to the main shaft housing, a plurality of sensors extending through the apparatus body, each sensor having a sensor head adjacent an exterior surface of the main shaft, each sensor for sensing deflection of the main shaft with respect to the sensor head.

2. The top drive system of claim 1 wherein the sensing apparatus is on the main shaft housing.

3. The top drive system of claim 1 wherein the sensing apparatus is on the main shaft.

4. The top drive system of claim 1 wherein each sensor is an inductive proximity distance sensor.

5. The top drive system of claim 4 wherein each sensor is removably located in the apparatus body.

6. The top drive system of claim 1 wherein each sensor is an analog distance sensor.

7. The top drive system of claim 4 wherein the sensors are spaced-apart around the apparatus body and each sensor is supported by a support which allows fine radial adjustment of the position of the sensor's sensor head with respect to the main shaft.

8. The top drive system of claim 1 further comprising a control system in communication with each sensor for monitoring sensor output.

9. The top drive system of claim 8 wherein the control system provides an operator with an indication of main shaft deflection in real-time.

10. The top drive system of claim 9 wherein the control system provides an operator with a warning of undesirable main shaft deflection in real-time.

11. The top drive system of claim 1 wherein the sensing apparatus has at least one sensor that is one of capacitative proximity sensor, ultrasonic distance sensor, photoelectric sensor, laser distance-measuring sensor, and inductive proximity distance sensor.

12. The top drive system of claim 1 wherein the sensing apparatus senses main shaft deflection in real-time.

13. The top drive system of claim 1 wherein the main shaft has an outer diameter of about nine inches.

14. A top drive system for wellbore operations above a well, the top drive system comprising a main body, a main shaft extending from the main body, the main shaft having a top end and a bottom end, the main shaft having a main shaft flow bore therethrough from top to bottom through which drilling fluid is flowable, a main shaft housing enclosing a portion of the main shaft, the main shaft having a non- loaded position relative to the main shaft housing, sensing apparatus located for sensing bending of the main shaft away from the non-loaded position, an apparatus body connected to the main shaft housing, a plurality of sensors extending through the apparatus body, each sensor having a sensor head adjacent an exterior surface of the main shaft, each sensor for sensing deflection of the main shaft with respect to the sensor head, each sensor is an inductive proximity distance sensor, wherein each sensor is removably located in the apparatus body,a control system in communication with each sensor for monitoring sensor output, wherein the control system provides an operator with an indication of main shaft deflection in real-time, and wherein the control system provides an operator with a warning of undesirable main shaft deflection in real-time.

15. A method for sensing deflection of a main shaft of a top drive system, the top drive system comprising a main body, a main shaft extending from the main body, the main shaft having a top end and a bottom end, the main shaft having a main shaft flow bore therethrough from top to bottom through which drilling fluid is flowable, a main shaft housing enclosing a portion of the main shaft, the main shaft having a non-loaded position relative to the main shaft housing, and, sensing apparatus located for sensing bending of the main shaft away from the non-loaded position, the method including sensing with the sensing apparatus position of the main shaft, and, wherein the sensing apparatus includes an apparatus body connected to the main shaft housing, a plurality of sensors extending through the apparatus body, each sensor having a sensor head adjacent an exterior surface of the main shaft, each sensor for sensing deflection of the main shaft with respect to the sensor head, each sensor is removably located in the apparatus body, and wherein the sensors are spaced-apart around the apparatus body and each sensor is supported by a support which allows fine radial adjustment of the position of the sensor's sensor head with respect to the main shaft, the method further comprising radially adjusting the position of each sensor head with respect to the main shaft.

16. The method of claim 15 wherein a control system in communication with each sensor for monitoring sensor output and wherein the control system provides an operator with an indication of main shaft deflection in real-time, the method further including providing, with the control system, in real-time an indication of main shaft deflection.

17. The method of claim 15 wherein the control system provides an operator with a warning of undesirable main shaft deflection in real-time, the method further comprising providing such a warning.

* * * * *